United States Patent [19]

Rietti

[11] 3,986,666

[45] Oct. 19, 1976

[54] DISTRIBUTOR FOR HOT WATER HEATING SYSTEMS

[76] Inventor: Antonio Rietti, Via Circonvallazione, 5, 65017 Penne (PE), Italy

[22] Filed: Jan. 2, 1976

[21] Appl. No.: 646,008

[52] U.S. Cl. ..... 237/59; 62/513

[51] Int. Cl.[2] ..... F24D 3/00

[58] Field of Search ..... 237/59, 67, 71; 165/50; 62/513

[56] References Cited

UNITED STATES PATENTS 3,008,692 11/1961 Gerard ..... 165/57

FOREIGN PATENTS OR APPLICATIONS 1,180,463 2/1970 United Kingdom ..... 237/59

*Primary Examiner*—William E. Wayner
*Assistant Examiner*—Henry C. Yuen
*Attorney, Agent, or Firm*—Rummler & Snow

[57] ABSTRACT

This invention relates to a water distributor for fluid water heating/cooling systems, having a pair of large conduits arranged side-by-side in spaced relation to each other with smaller dispersion conduits extending laterally from each large conduit and some partially extending into and through both large conduits, whence they either extend to radiators or return to one of the large conduits.

4 Claims, 4 Drawing Figures

DISTRIBUTOR FOR HOT WATER HEATING SYSTEMS

BACKGROUND OF THE INVENTION

Water distributing systems per se are old in the art as shown by patents:

| | |
|---|---|
| 400,258 to Shackleton | 2,425,775 to Yarborough |
| 1,038,024 to Talbot | 3,008,692 to Gerard |

as found in a search through certain subclasses of both Class 165 and Class 237. However, none disclosed the unique device of the present invention.

SUMMARY OF THE INVENTION

A fluid distributor having a pair of large spaced conduits arranged in side-by-side relationship and a series of smaller conduits extending therefrom at right angles thereto, said smaller conduits extending from each of said large conduits into and through the other of said large conduits and secured thereto. Dispersion conduits leading from one of said large spaced conduits extend to radiators or the like to bring hot/cold fluid thereto, while other conduits extend from the radiators or the like to return the fluid to the other of said large spaced conduits.

DETAILED DESCRIPTION OF THE DRAWINGS

Figures 1, 2, 3, 4:
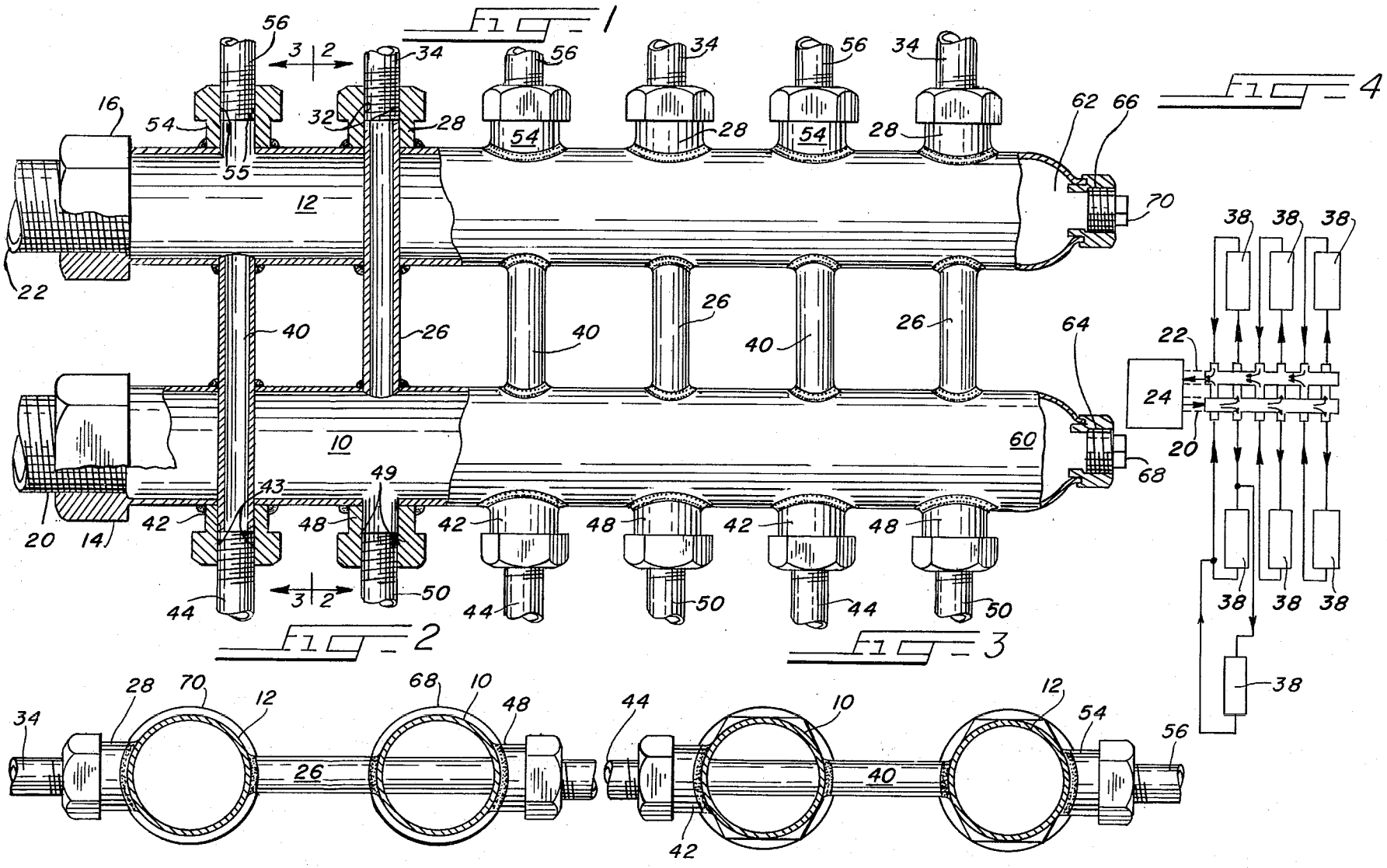
FIG. 1 is a top plan view of the device of the present invention with parts broken away and in cross-section.
FIG. 2 is a cross-sectional view taken on the lines 2—2 of FIG. 1.
FIG. 3 is a cross-sectional view taken on the lines 3—3 of FIG. 1.
FIG. 4 is a flow diagram.

The fluid distributor disclosed in the drawings is especially designed to be used in a hot water heating system and distributes fluids to radiators located in various rooms of a house or building and preheats in some degree the fluid returning from the radiators.

It is to be understood that although a few radiators are shown in the flow diagram of FIG. 4 of the drawings, the distributor may handle as many radiators as desired. Further, although only one distributor is shown in the drawings, the size may be varied at will or a second or third added in tandem as will hereinafter be explained.

The fluid distributor shown comprises a pair of large diameter conduits or tubes 10–12 spaced in side-by-side relationship and each opened at least at one end. These ends are provided with internal threads 14–16 formed therein for the reception of the threaded ends of conduits 20, 22 leading from and to a hot fluid boiler 24 or solar tanks (not shown), respectively. The hot fluid conduit 20 brings hot fluid to tube 10 while the return boiler conduit 22 returns the fluid to the boiler 24 from tube 12, as will be hereinafter explained.

As seen in FIG. 1, hot fluid connector conduits 26 extend from tube 10 to and through the tube 12 of the distributor normal to the axis of tube 12 and terminate in a hollow boss 28 formed on tube 12 which is internally threaded at 32. The ends of dispersion conduits 34 are each provided with the male threads 36 for engaging the threads 36 of boss 32. The dispersion conduits 34 extend to the inlet side of one or more radiators 38. If more radiators are desired, suitable additional distributor conduits may be used.

Cool fluid connector conduits 40 extend from tube 12 of the distributor to and through tube 10 normal to the axis thereof and terminate in a hollow boss 42 on tube 10 which is provided with internal threads 43. Each of the outer ends of return conduits 44 is provided with external threads for engagement with threads 43 and the cool fluid return conduits 44 extend to the outlet side of the radiators 38.

As shown, the cool fluid connector conduits 40 extend through the hot fluid tube 10 of the distributor whereby the conduits 40 are partially warmed by the hot fluid in conduit 10 and thus warm the fluid returning to the hot water boiler. Thus the fluid returning to the boiler takes less time to heat up.

Referring again to FIG. 1 and distributor tube 10, hollow bosses 48 are anchored thereto and have communication with the interior of tube 10. The bosses 48 are each provided with interior threads 49 and the openings in these bosses are in alignment with the opening in the bosses 28. Dispersion conduits 50 have one end provided with male threads for interconnection with the threads 49 in the boss 48. The opposite ends of the dispersion conduits are each connected to the intake ends of the radiators 38 for feeding hot fluid thereto.

The tube 12 is also provided with hollow bosses 54 anchored thereto and communicating with the interior of tube 12. The bosses 54 are internally threaded as at 55 and the openings in the bosses 54 are in alignment with the openings in bosses 42. One end of each dispersion conduit 56 is provided with male threads in one end thereof for interconnection with the threads 55 on boss 54. The other end of distributor conduits 56 is connected to the return side of the radiators 38 for returning the fluid to tube 12 and thence to the boiler 24 via conduit 22.

If the building using the distributor system shown in the drawings has many radiators, then a duplicate of the distributor shown in FIG. 1 is attached to the ends 60, 62 which are provided with internal threads 64, 66 and connected together by a short nipple and union. If one distributor is adequate for the heating system, then pipe plugs 68, 70 are secured to the ends of tubes 10, 12 as shown in FIG. 1.

In operation, the hot fluid from the boiler 24 flows through hot fluid water conduits 20 to tube 10 of the distributor where it is directed through dispersion conduits 34 and 50 to the inlet side of radiators 38. The fluid returns to tube 12 from the return side of the radiators 38 via return cool fluid conduits 44 and 56. Then the returned fluid is fed back to the boiler through boiler conduit 22.

The connector conduits 26 extending from tube 12 through tube 10 of the distributor will partially warm the fluid returning from the radiators 38 and in tube 12.

The connector conduits 40 extending through the tube 10 of the distributor to tube 12 also tend to warm the fluid returning from the radiators 38.

The connector conduits 26 and 40 are held in position by welding or braising to the outer surfaces of tubes 10, 12 where they are in contact as shown in the drawing.

As shown in FIG. 1, there are six outlets in tube 10 and six inlets in tube 12 but the number of inlets and outlets may be increased by the length of the tubes and so long as the inlets and outlets are equal in number.

It should be obvious that although this invention is described for use in hot fluid heating systems, this distributor may be used with steam or other fluid systems.

Further, the distributor may be used in connection with cold fluid air conditioning units.

Further, the system may be used with oil or water or a combination thereof in connection with machine shop machines.

Although but one specific embodiment of this invention is herein shown and described, it will be understood that details of the construction shown may be altered or omitted without departing from the spirit of the invention as defined by the following claims.

I claim:

1. A distributor for fluid systems which includes a source for producing a hot fluid having a hot fluid outlet and a cool return inlet and a series of radiators having inlets and outlets comprising, in combination, a pair of first and second large tubes positioned in side-by-side spaced relationship, hot fluid conduits connected between the source of hot fluid and said first tube to supply hot fluid thereto, a second return cool fluid conduit connected between the return fluid inlet of said source and to one end of said second tube, a series of dispersion conduits extending from said first tube and extending to the inlet side of said radiators, cold fluid return conduits extending between the outlet end of said radiators and said second tube for return to said source of hot fluid, and connecting means between said first and second tubes for warming the fluid in said second tube.

2. The device according to claim 1 wherein said connecting means are conduits extending from said first tube and through said second tube, and between said second tube and through said first tube.

3. The device according to clam 2 wherein said connecting means are conduits extending between said first and second tubes and normal to the axis of said tubes, and secured to said tubes.

4. The device according to claim 1 wherein the hot fluid is a cold fluid for air conditioning systems.

* * * * *